US010126707B2

(12) United States Patent
Tsuchiya

(10) Patent No.: US 10,126,707 B2
(45) Date of Patent: Nov. 13, 2018

(54) PAPER HUMIDIFIER AND IMAGE FORMING SYSTEM

(71) Applicant: KONICA MINOLTA, INC., Chiyoda-ku, Tokyo (JP)

(72) Inventor: Tsuyoshi Tsuchiya, Hachioji (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/684,994

(22) Filed: Aug. 24, 2017

(65) Prior Publication Data

US 2018/0059616 A1 Mar. 1, 2018

(30) Foreign Application Priority Data

Aug. 31, 2016 (JP) ..... 2016-168891

(51) Int. Cl.

| | |
|---|---|
| ***G03G 21/00*** | (2006.01) |
| ***G03G 21/20*** | (2006.01) |
| ***G03G 15/20*** | (2006.01) |
| ***G03G 15/00*** | (2006.01) |
| *G03G 15/08* | (2006.01) |

(52) U.S. Cl.

CPC ..... *G03G 21/203* (2013.01); *G03G 15/206* (2013.01); *G03G 15/2064* (2013.01); *G03G 15/6573* (2013.01); *G03G 15/0887* (2013.01); *G03G 15/2096* (2013.01); *G03G 2215/0067* (2013.01); *G03G 2215/00776* (2013.01)

(58) Field of Classification Search

CPC ..... G03G 15/2064; G03G 15/2089; G03G 15/0846; G03G 15/2096; G03G 15/6573; G03G 15/6576; G03G 21/203; G03G 2215/00776; G03G 2215/00426; G03G 2215/00662; G03G 15/206; G03G 15/0887; G03G 2215/0067; B65H 2301/51256

See application file for complete search history.

(56) References Cited

U.S. PATENT DOCUMENTS 5,895,154 A * 4/1999 Acquaviva ..... G03G 15/6573 399/341
2011/0116852 A1* 5/2011 Ogushi ..... G03G 15/6576 399/341

(Continued)

FOREIGN PATENT DOCUMENTS

JP 2012-024953 A 2/2012

*Primary Examiner* — Sophia S Chen
(74) *Attorney, Agent, or Firm* — Buchanan Ingersoll & Rooney PC

(57) ABSTRACT

A paper humidifier includes a humidifying roller, a water supply roller, a suction roller and an intermediate roller. The humidifying roller comes in contact with a sheet and humidifies the sheet. The water supply roller is in contact with the humidifying roller and transfers water to the humidifying roller. The suction roller is partially dipped into water stored in a water reservoir. The intermediate roller is provided between the water supply roller and the suction roller, and is in contact with the water supply roller and the suction roller respectively. The intermediate roller is located above a liquid level of the water stored in the water reservoir. An outer peripheral surface of the suction roller, which rises out of the water stored in the water reservoir after being dipped in the water, rotates in a direction away from the water supply roller.

15 Claims, 5 Drawing Sheets

(56) References Cited

U.S. PATENT DOCUMENTS

| | | | | |
|---|---|---|---|---|
| 2015/0115527 | A1* | 4/2015 | Takematsu | G03G 15/6573 271/265.01 |
| 2016/0077481 | A1* | 3/2016 | Katano | G03G 15/6576 399/406 |
| 2016/0282796 | A1* | 9/2016 | Tanaka | G03G 15/6573 |

* cited by examiner

PAPER HUMIDIFIER AND IMAGE FORMING SYSTEM

Japanese Patent Application No. 2016-168891 filed on Aug. 31, 2016 including description, claims, drawings, and abstract the entire disclosure is incorporated herein by reference herein in its entirely.

BACKGROUND

Technological Field

The present invention relates generally to a paper humidifier and an image forming system.

Description of the Related Art

In accordance with an electrophotographic process for forming an image, during a fixing step of the process, toner is melted by heat and is given pressure to form an image on a sheet. There may occur the phenomenon that moisture evaporates from the sheet due to the heat during this fixing step, and that the sheet absorbs moisture from outside air after the fixing step. The evaporation or absorption of moisture may cause the problem of having a sheet be warped or curled.

Because of this, it has been proposed to perform humidification by supplying water to a sheet on which an image is formed (for example, refer to Japanese Unexamined Patent Application Publication No. 2012-24953). The recording material processing apparatus described in Japanese Unexamined Patent Application Publication No. 2012-24953 is provided with a water supply roll, a water amount adjustment roll for adjusting the amount of water which is transferred to the surface of the water supply roll by coming in contact with the water supply roll, and a water acquisition roll which is dipped in a water reservoir to acquire water and supply the water amount adjustment roll with water.

Incidentally, the humidification of a sheet is performed not only for the purpose of correcting the sheet which is warped or curled but also for the other purpose, e.g., of removing electricity from the sheet.

SUMMARY

However, there may occur the problem that water is excessively supplied due to the surface tension of water stored in the water reservoir, resulting in excessive humidification.

Taking into consideration the above circumstances, it is an object of the present invention therefore to provide a paper humidifier and an image forming system in which a sheet can be appropriately humidified by inhibiting water from being excessively supplied.

To achieve at least one of the abovementioned objects, according to an aspect of the present invention, a paper humidifier reflecting one aspect of the present invention comprises: a humidifying roller which comes in contact with a sheet being conveyed, and humidifies the sheet; a water supply roller which is in contact with the humidifying roller and transfers water to the humidifying roller; a suction roller which is partially dipped into water stored in a water reservoir; and an intermediate roller which is provided between the water supply roller and the suction roller, and is in contact with the water supply roller and the suction roller respectively, wherein the intermediate roller is located above a liquid level of the water stored in the water reservoir, and wherein an outer peripheral surface of the suction roller, which rises out of the water stored in the water reservoir after being dipped in the water, rotates in a direction away from the water supply roller.

BRIEF DESCRIPTION OF THE DRAWINGS

The advantages and features provided by one or more embodiments of the invention will becomes more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
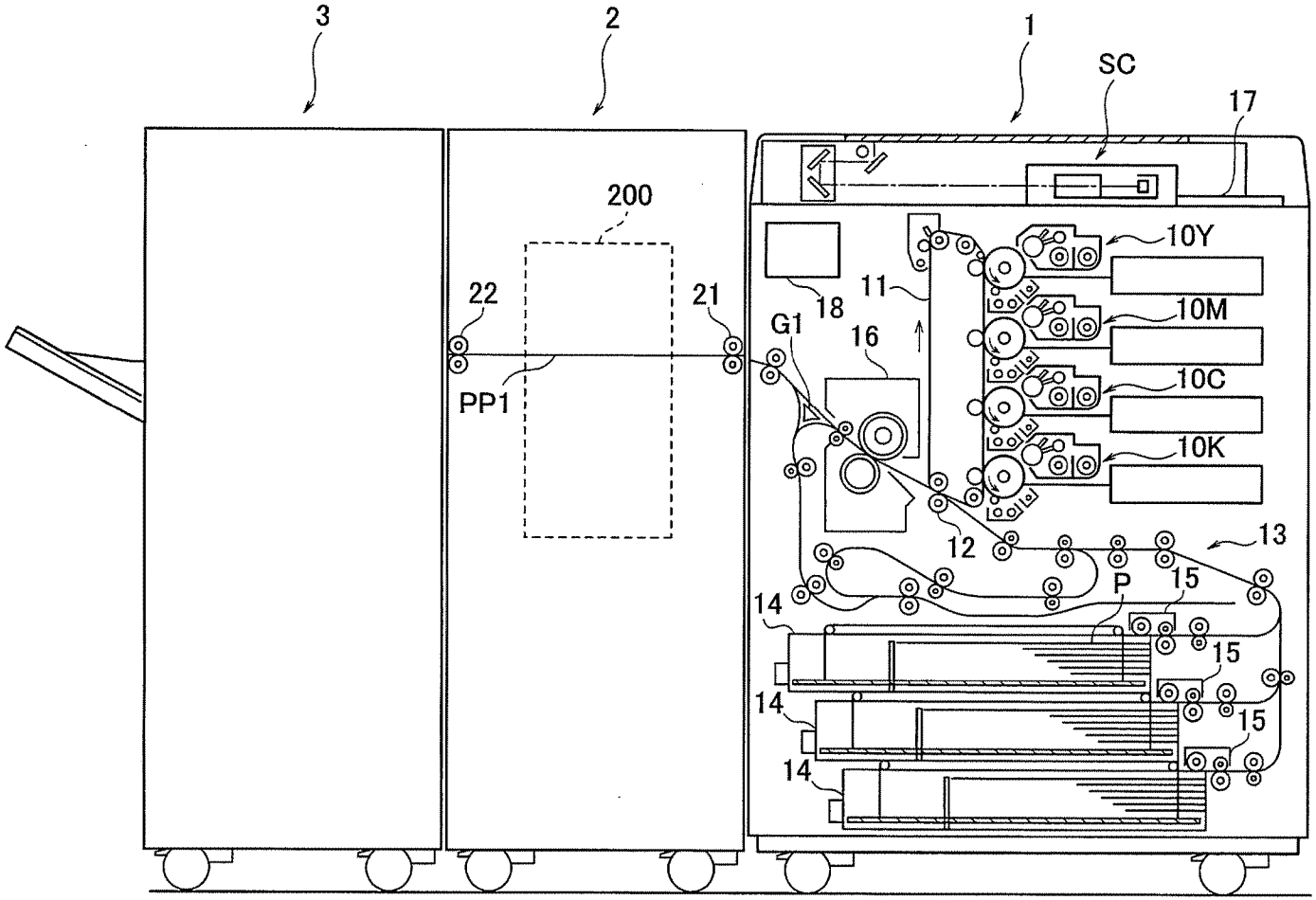
FIG. 1 is a front view for schematically showing an image forming system in accordance with the present embodiment.

FIG. 1 is a front view for schematically showing an image forming system in accordance with the present embodiment. The image forming system of the present embodiment includes an image forming apparatus 1, an intermediate conveyance unit 2 and a sheet processing apparatus 3. The image forming apparatus 1, the intermediate conveyance unit 2 and the sheet processing apparatus 3 are continuously arranged in this order from the upstream side to the downstream side in the conveying direction of a sheet P.

The image forming apparatus 1 is, for example, an electrophotographic image forming apparatus called a tandem color image forming apparatus for forming full-color images. The image forming apparatus 1 is composed mainly of an original reading unit SC, image forming units 10Y, 10M, 10C and 10K, a paper conveying unit 13, a fixing unit 16 and a control unit 18.

The original reading unit SC irradiates an image of an original with a lighting device, and reads light reflected therefrom with a line image sensor to obtain an image signal. This image signal is processed by performing A/D conversion, shading compensation, data compression and so on, and then input to the control unit 18 as image data. Incidentally, the image data input to the control unit 18 is not limited to the image data as captured by the original reading unit SC, but can be the data for example as received from another image forming apparatus, a personal computer or the like connected to the image forming apparatus 1, or stored in a portable recording medium such as a USB memory.

These image forming units 10Y, 10M, 10C and 10K are an image forming unit 10Y for forming yellow images, an image forming unit 10M for forming magenta images, an image forming unit 10C for forming cyan images, and an image forming unit 10K for forming black images.

The image forming unit 10Y consists of a photoreceptor drum, and a charging unit, an optical writing unit, a development apparatus and a drum cleaner which are arranged around the photoreceptor drum. An image (toner image) corresponding to yellow is thereby formed on the photoreceptor drum of the image forming unit 10Y, and is transferred to a predetermined location of an intermediate transfer belt 11, which is an endless belt, by a first transfer roller.

Also, each of the other image forming units 10M, 10C and 10K consists of a photoreceptor drum, and a charging unit, an optical writing unit, a development apparatus and a drum cleaner which are arranged around the photoreceptor drum. The details of these image forming units are same as those of the image forming unit 10Y.

After transferred to the intermediate transfer belt 11, the toner images are transferred by a second transfer roller 12 to a sheet P which is conveyed with a predetermined timing by a paper feed unit 13.

The paper conveying unit 13 conveys a sheet P along a conveying route. Sheets P are stored in paper feed trays 14, extracted by paper feed units 15 and transferred to the conveying route. The sheets P transferred to the conveying route are conveyed by conveyance rollers to the downstream side.

The fixing unit 16 is an apparatus which performs a fixing process of fixing an image on a sheet P. The fixing unit 16 includes a fixing roller, a pressure roller and a heater for heating the fixing roller. The fixing unit 16 conveys a sheet P and fixes an image to the sheet P by pressure fixing with the fixing roller and the pressure roller and thermal fixing with the heater.

After the fixing process, the sheet P is discharged to the intermediate conveyance unit 2 through the conveying route in the downstream side of the fixing unit 16. In the case where an image is to be formed also on the back side of a sheet P, a switching gate G1 is switched to transfer the sheet P to a reversing conveying route.

An operation panel 17 is an input unit in the form of a touch panel through which information can be input in accordance with information displayed on a display. A user can set a variety of parameters such as information about a sheet P (the type of paper and the like), the density and reduce/enlarge ratio of an image and so forth through operation of the operation panel 17. The information which is set is input to the control unit 18. Also, the operation panel 17 is controlled by the control unit 18 to display various information to a user through the operation panel 17 itself.

The control unit 18 controls the image forming apparatus 1, and generally controls the entire image forming system. The control unit 18 is implemented with a microcomputer which consists mainly of a CPU, a ROM, a RAM, and an I/O interface. The control unit 18 controls the image forming units 10Y, 10M, 10C and 10K, the fixing unit 16 and the like to form an image on a sheet P.

The intermediate conveyance unit 2 processes a sheet P which is supplied from the image forming apparatus 1, and discharge the processed sheet P to the sheet processing apparatus 3. The intermediate conveyance unit 2 according to the present embodiment is provided with a paper humidifier 200 which supplies moisture to a sheet P supplied from the image forming apparatus 1 to remove warp, undulation, curve or the like deformation of the sheet P, or remove electricity by the moisture. In addition, the intermediate conveyance unit 2 may be provided with other functional units such as a decurler for correcting a sheet P.

After taken in the intermediate conveyance unit 2 by paper feed rollers 21, a sheet P supplied from the image forming apparatus 1 is conveyed through a conveying route PP1, and discharged to the sheet processing apparatus 3 by discharging rollers 22. The conveying route PP1 is a conveying route for conveying a sheet P in the horizontal direction, and provided with conveyance rollers which are not shown in the figure.

Figure 2:
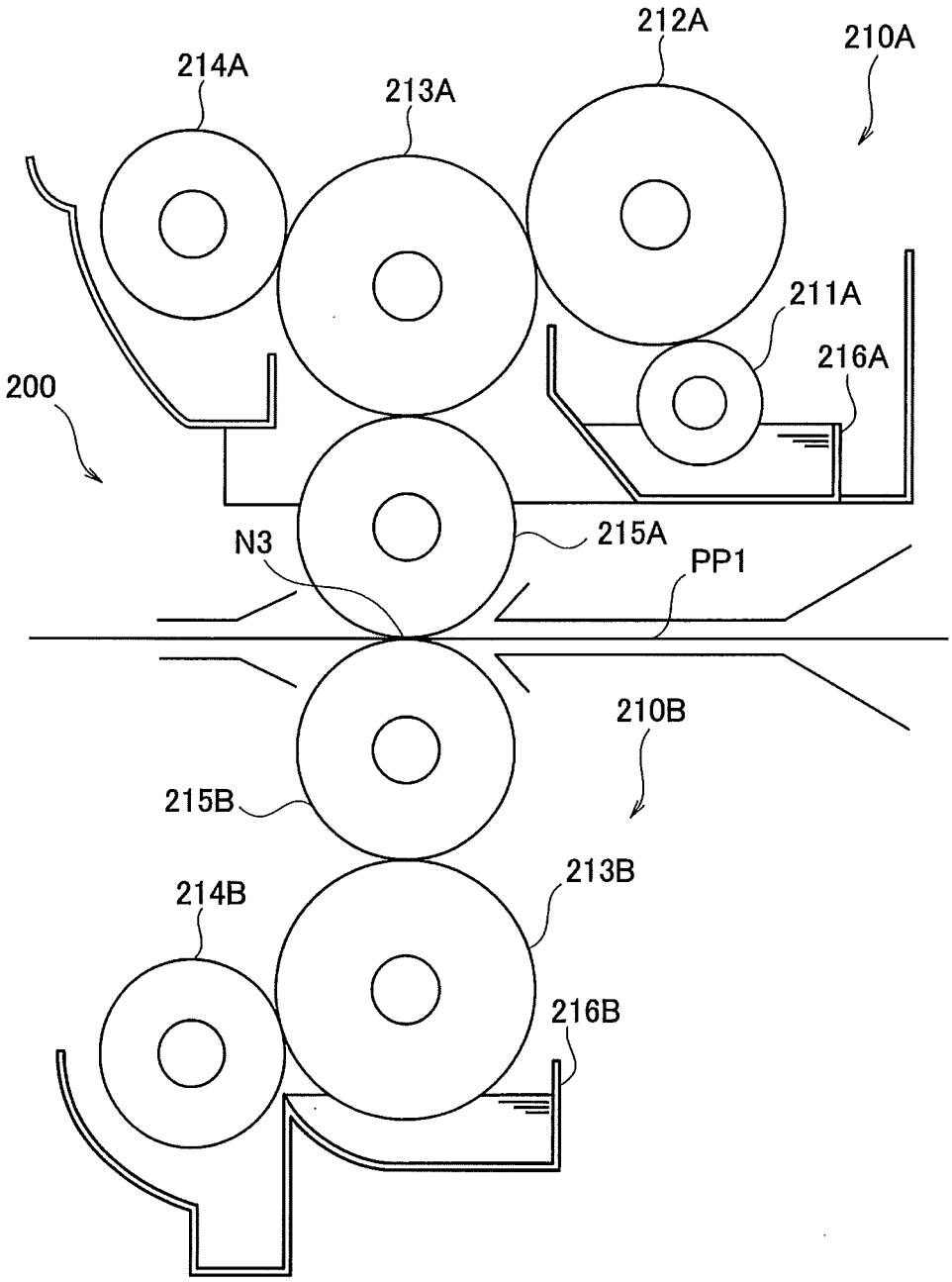
FIG. 2 is a front view for schematically showing the configuration of a paper humidifier.

FIG. 2 is a front view for schematically showing the configuration of the paper humidifier 200. The paper humidifier 200 is arranged on the conveying route PP1, and consists mainly of a pair of humidification units 210A and 210B and a tank (not shown) which supplies water to the pair of humidification units 210A and 210B. The pair of humidification units 210A and 210B are vertically arranged opposite to each other with the conveying route PP1 therebetween. Specifically, the first humidification unit 210A is arranged above the conveying route PP1, and the second humidification unit 210B is arranged below the conveying route PP1.

The first humidification unit 210A consists mainly of a suction roller 211A, an intermediate roller 212A, a water supply roller 213A, a drainer roller 214A, a humidifying roller 215A and a water reservoir 216A.

The suction roller 211A sucks water stored in the water reservoir 216A, and transfers the water to the intermediate roller 212A. This suction roller 211A is partially dipped in the water stored in the water reservoir 216A. The suction roller 211A is composed for example of a shaft made of a metal and a resin layer formed on the shaft.

The intermediate roller 212A is arranged between the suction roller 211A and the water supply roller 213A, and comes in contact with both the suction roller 211A and the water supply roller 213A. This intermediate roller 212A transfers water, which is transferred from the suction roller 211A, to the water supply roller 213A. The intermediate roller 212A is composed for example of a shaft made of a metal and a rubber layer formed on the shaft.

The water supply roller 213A is arranged between the humidifying roller 215A and the intermediate roller 212A, and comes in contact with both the humidifying roller 215A and the intermediate roller 212A. The water supply roller 213A transfers water, which is transferred from the intermediate roller 212A, to the humidifying roller 215A. The water supply roller 213A is composed for example of a shaft made of a metal and a resin layer formed on the shaft.

The drainer roller 214A is arranged to come in contact with the water supply roller 213A. The drainer roller 214A makes appropriate the amount of water on the outer peripheral surface of the water supply roller 213A by draining water from the outer peripheral surface of the water supply roller 213A.

The humidifying roller 215A is arranged below the water supply roller 213A and receives water transferred from the water supply roller 213A. This humidifying roller 215A retains water on the outer peripheral surface thereof, and humidifies a sheet P which comes in contact with this outer peripheral surface. The humidifying roller 215A is composed for example of a shaft made of a metal and a rubber layer formed on the shaft.

The water reservoir 216A is supplied with water from the tank through a water supply conduit which is not shown in the figure. The water reservoir 216A is provided with a capacity for storing a predetermined amount of water. Also, the water reservoir 216A is provided with an over flow structure so that water overflowing from the water reservoir 216A is drained through an intermediate conduit which is not shown in the figure.

The second humidification unit 210B consists mainly of a water supply roller 213B, a drainer roller 214B, a humidifying roller 215B and a water reservoir 216B.

The water supply roller 213B sucks water stored in the water reservoir 216B, and transfers the water to the humidifying roller 215B. This water supply roller 213B is partially dipped in the water stored in the water reservoir 216B. The water supply roller 213B is composed for example of a shaft made of a metal and a resin layer formed on the shaft.

The drainer roller 214B is arranged to come in contact with the water supply roller 213B. The drainer roller 214B makes appropriate the amount of water on the outer peripheral surface of the water supply roller 213B by draining water from the outer peripheral surface of the water supply roller 213B.

The humidifying roller 215B is arranged above the water supply roller 213B and receives water transferred from the water supply roller 213B. This humidifying roller 215B retains water on the outer peripheral surface thereof, and humidifies a sheet P which comes in contact with this outer peripheral surface. The humidifying roller 215B is composed for example of a shaft made of a metal and a rubber layer formed on the shaft.

The water reservoir 216B is supplied with water through an intermediate conduit. The water reservoir 216B is provided with a capacity for storing a predetermined amount of water. Also, the water reservoir 216B is provided with an over flow structure so that water overflowing from the water reservoir 216B is drained to the tank through a drainage conduit which is not shown in the figure.

The tank stores water for humidifying a sheet P. This tank may be provided with a heater or the like for heating water stored in the tank, i.e., water to be supplied to the humidification units 210A and 210B.

In the paper humidifier 200 constructed as described above, the humidifying roller 215A of the first humidification unit 210A and the humidifying roller 215B of the second humidification unit 210B are vertically arranged with the conveying route PP1 located therebetween. Then, while the pair of humidifying rollers 215A and 215B are rotated with a sheet P therebetween, the sheet P is conveyed with its opposite surfaces being in contact with the humidifying rollers 215A and 215B respectively. Water is thereby transferred to the opposite surfaces of the sheet P to humidify the sheet P.

Incidentally, the paper humidifier 200 may be provided with another conveying route through which a sheet P is conveyed to the discharging roller 22 by bypassing the paper humidifier 200. Furthermore, in the case where the intermediate conveyance unit 2 is provided with a decurler or the like, the conveying route PP1 is provided in order that a sheet P passed through the paper humidifier 200 is processed by the decurler, and then conveyed to the discharging roller 22.

Referring to FIG. 1 again, the sheet processing apparatus 3 is an apparatus for performing a post-printing process with a sheet P supplied from the intermediate conveyance unit 2. The post-printing process is for example a folding process of folding a sheet P in various ways, a punching process of punching a sheet P, a bookbinding process of folding, saddle-stitching and trimming a plurality of sheets P, a staple process of stapling a plurality of sheets P together, or the like. The sheet processing apparatus 4 performs a predetermined post-printing process with a sheet P, or does not performs any post-printing process with the sheet P, and discharges the sheet P to a catch tray which is located outside the apparatus.

Figure 3:
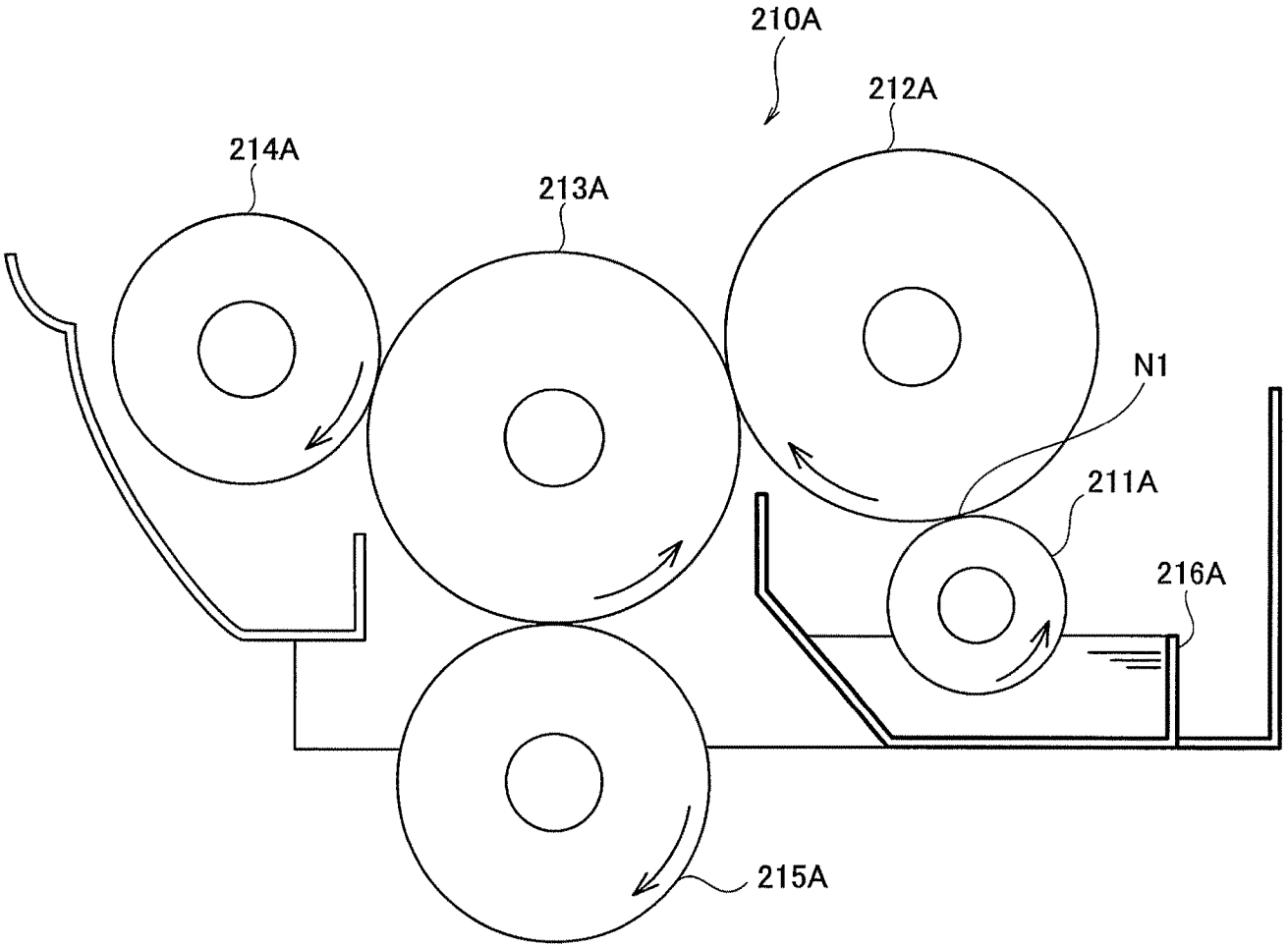
FIG. 3 is a front view for schematically showing the configuration of a first humidification unit.

In what follows, the first humidification unit 210A of the paper humidifier 200 will be explained as one of the features of the present embodiment. FIG. 3 is a front view for schematically showing the configuration of the first humidification unit 210A.

The first humidification unit 210A according to the present embodiment has a structure in which the intermediate roller 212A is located between the suction roller 211A and the water supply roller 213A. In this case, the intermediate roller 212A is located above the liquid level of water stored in the water reservoir 216A in order that a nip portion N1 between the intermediate roller 212A and the suction roller 211A is located above the water reservoir 216A.

Since the intermediate roller 212A is interposed between the suction roller 211A and the water supply roller 213A, the rotation direction of the water supply roller 213A becomes equal to the rotation direction of the suction roller 211A as indicated with arrows in the figure (in the counter clockwise direction in the figure). Because of this, after being dipped into water of the water reservoir 216A, the outer peripheral surface of the suction roller 211A, which rises out of the water stored in the water reservoir, rotates in the direction away from the water supply roller 213A.

Figure 4:
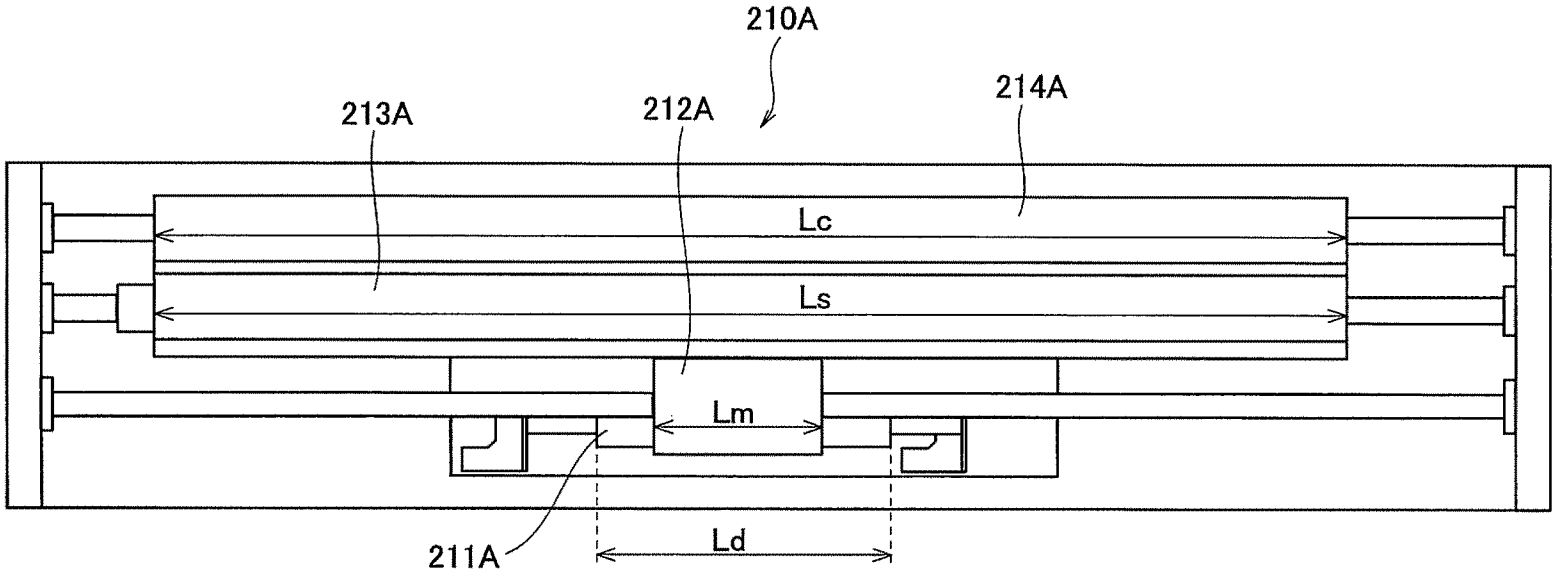
FIG. 4 is a top view for schematically showing the configuration of the first humidification unit.

FIG. 4 is a top view for schematically showing the configuration of the first humidification unit 210A. The length Lm of the intermediate roller 212A in the axial direction is shorter than the length Ls of the water supply roller 213A in the axial direction ($Lm<Ls$). The length Ls of the water supply roller 213A in the axial direction is equal to or shorter than the length Lc of the drainer roller 214A in the axial direction ($Ls \leq Lc$). Furthermore, the length Lm of the intermediate roller 212A in the axial direction is shorter than the length Ld of the suction roller 211A in the axial direction ($Ld>Lm$).

In this structure of the first humidification unit 210A, water stored in the water reservoir 216A is supplied from the suction roller 211A to the humidifying roller 215A through the intermediate roller 212A and the water supply roller 213A.

Specifically, water is retained on the outer peripheral surface of the suction roller 211A by dipping the suction roller 211A into water stored in the water reservoir 216A, and the water is transferred to the intermediate roller 212A during the rotation of the suction roller 211A. Since the suction roller 211A rotates in the direction away from the water supply roller 213A, water conveyed by the suction roller 211A is transferred to the intermediate roller 212A along the outer side of the suction roller 211A (i.e., the right side in FIG. 3).

Water transferred to the intermediate roller 212A is retained on the outer peripheral surface thereof, and then transferred to the water supply roller 213A by the rotation of the intermediate roller 212A. Water transferred to the water supply roller 213A is retained on the outer peripheral surface thereof. Water retained on the water supply roller 213A is spread in the axial direction by the drainer roller 214A which is in contact with the water supply roller 213A so that the amount of water is uniformized and that excess water is absorbed. Then, water retained on the water supply roller 213A is transferred to the humidifying roller 215A by the rotation of the water supply roller 213A. While rotating, the humidifying roller 215A transfers water to a sheet P coming in contact with the outer peripheral surface of the humidifying roller 215A. The conveyed sheet P is thereby humidified.

By this configuration, it is possible to inhibit water from being excessively supplied to the water supply roller 213A, and then from being supplied to the humidifying roller 215A.

Figure 5:
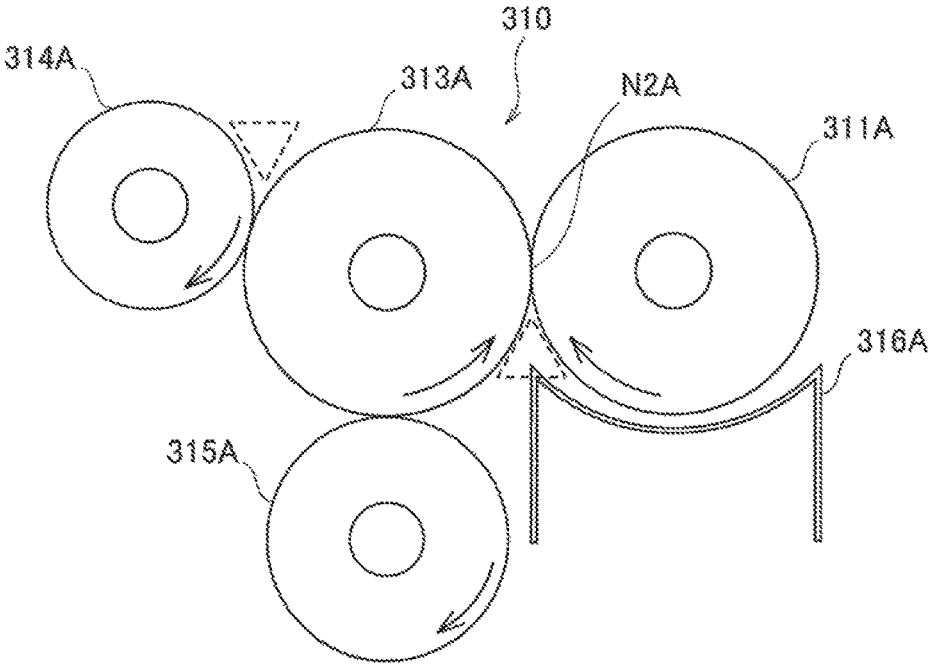
FIG. 5 PRIOR ART
FIG. 5 is an explanatory view for showing a humidification unit in comparison with the first humidification unit according to the present embodiment.

Incidentally, FIG. 5 is an explanatory view for showing a humidification unit 310 in comparison with the first humidification unit 210A according to the present embodiment. This humidification unit 310 is not provided with a roller corresponding to the intermediate roller 212A of the present embodiment, but consists mainly of a suction roller 311A, a water supply roller 313A, a drainer roller 314A, a humidifying roller 315A and a water reservoir 316A. In the humidification unit 310, water stored in the water reservoir 316A is supplied to the humidifying roller 315A from the suction roller 311A through the water supply roller 313A.

In this humidification unit 310, the suction roller 311A and the water supply roller 313A rotate in the opposite directions respectively so that the suction roller 311A rotates in a direction approaching the water supply roller 313A. Because of this, water carried by the suction roller 311A is transferred to the water supply roller 313A along the inner side of the suction roller 311A (the left side shown in FIG. 5). Namely, the rotation direction of the suction roller 311A becomes the direction toward the nip portion N2A of the water supply roller 313A. In this case, water is collected by the surface tension of water stored in the water reservoir 216A at a site indicated with a broken triangle in the figure to supply an excessive amount of water to the water supply roller 313A.

Even with the drainer roller 314A which adjusts the amount of water retained on the water supply roller 313A, water which cannot be absorbed lingers between the drainer roller 314A and the water supply roller 313A (at a site indicated with a broken triangle in the figure). In this case, the lingering water may overflow beyond the opposite ends of the roller and be supplied to the humidifying roller 315A.

In regard to this problem, in accordance with the present embodiment, the rotation direction of the suction roller 211A after being dipped is directed away from the water supply roller 213A. Because of this, it is possible to inhibit the situation that, when the suction roller 211A sucks water, the water supply roller 213A is excessively supplied with water. As a result, humidification can be performed in an appropriate manner by inhibiting excessive supply.

In addition, the length Lm of the intermediate roller 212A in the axial direction is set up to be shorter than the length Ld of the suction roller 211A in the axial direction. It is therefore possible to sufficiently transfer water from the suction roller 211A to the intermediate roller 212A so that it is possible to inhibit the shortage of humidification due to an insufficient quantity of water transferred to the intermediate roller 212A.

Furthermore, in accordance with the present embodiment, the intermediate roller 212A is set up in order that the nip portion N1 between the intermediate roller 212A and the suction roller 211A is located above the water reservoir 216A. Because of this, even in the case where water is accumulated between the suction roller 211A and the intermediate roller 212A due to excessive supply of water from the suction roller 211A to the intermediate roller 212A, the water reservoir 216A can receive water which overflows beyond the opposite ends of the suction roller 211A. It is therefore possible to inhibit the situation that water is excessively supplied to the humidifying roller 215A. As a result, appropriate humidification can be performed.

Furthermore, in accordance with the present embodiment, the length Lm of the intermediate roller 212A in the axial direction is set to be shorter than the length Ls of the water supply roller 213A in the axial direction. Accordingly, since the water supply roller 213A has a greater capacity for retaining water than the intermediate roller 212A, it is possible to inhibit the situation that water is excessively supplied to the water supply roller 213A.

Still further, in accordance with the present embodiment, the drainer roller 214A is provided in contact with the water supply roller 213A. This drainer roller 214A can optimize the amount of water which the water supply roller 213A retains. In addition, with the drainer roller 214A being in contact with the water supply roller 213A, it is possible to spread water transferred from the intermediate roller 212A, which is shorter than the water supply roller 213A, uniformly over the entirety of the water supply roller 213A. It is thereby-possible to inhibit uneven humidification.

Also, in accordance with the present embodiment, the humidifying roller 215A of the first humidification unit 210A and the humidifying roller 215B of the second humidification unit 210B are adjacently arranged in the vertical direction, and a sheet P to be humidified is conveyed through the nip portion N3 therebetween in the horizontal direction.

By this configuration, in the case of the first humidification unit 210A located above the sheet P, the water reservoir 216A cannot be located below the water supply roller 213A. The suction roller 211A has thereby to be provided for supplying water to the water supply roller 213A. In this case, the above various advantages can be enjoyed by making use of the intermediate roller 212A intervening between the water supply roller 213A and the suction roller 211A.

Furthermore, in accordance with the present embodiment, the outer peripheral surfaces of the suction roller 211A and the water supply roller 213A are made of a resin, and the outer peripheral surface of the intermediate roller 212A is made of a rubber.

By this configuration, it is possible to establish the relationship that the friction coefficient of the outer peripheral surface of the suction roller 211A is lower than the friction coefficient of the outer peripheral surface of the intermediate roller 212A, and that the friction coefficient of the outer peripheral surface of the water supply roller 213A is lower than the friction coefficient of the outer peripheral surface of the intermediate roller 212A. This relationship makes it possible to obtain the advantages that the rotational performance between these rollers is improved and that the water transferring performance between these rollers is improved.

Incidentally, while the present invention is not applied to the second humidification unit 210B in the case of the above embodiment, the second humidification unit 210B can be designed in the same manner as the first humidification unit 210A.

Figure 6:
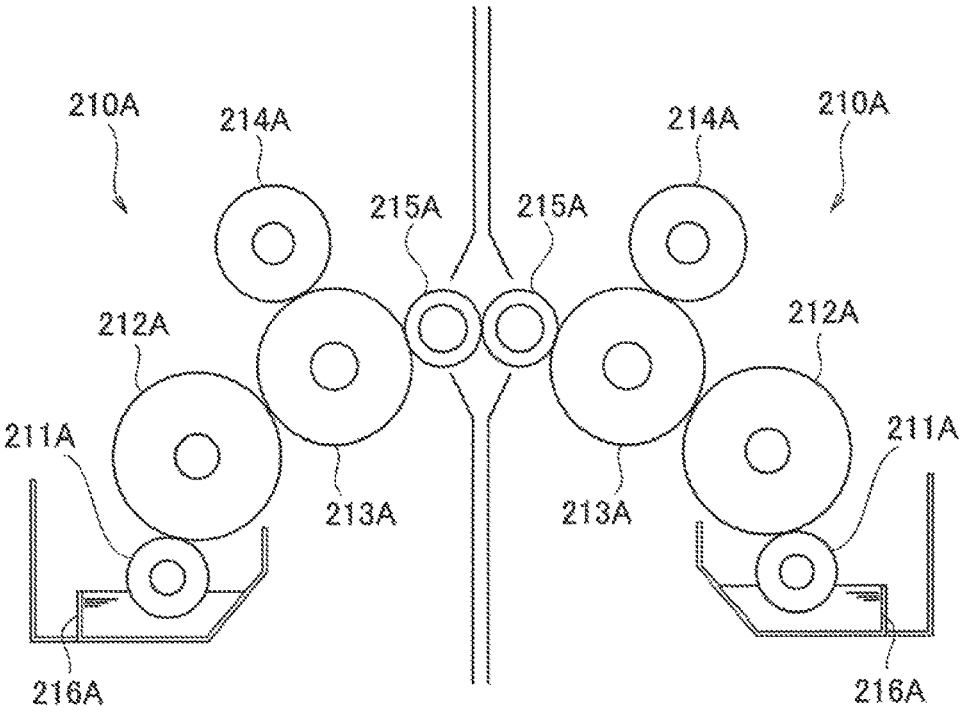
FIG. 6 is an explanatory view for showing an exemplary modification of the paper humidifier in accordance with the present embodiment.

Also, while the pair of humidification units 210A and 210B are vertically arranged in order to convey a sheet therebetween in the horizontal direction in the case of the above embodiment, a pair of humidification units (for example, as constructed in the same manner as the first humidification unit 210A) can be horizontally arranged so that a sheet is conveyed in the vertical direction as illustrated in FIG. 6.

Furthermore, it is noted that, as used in this specification and the appended claims, the term "water" is intended to include also a water solution or another liquid which can be used to perform humidification of paper.

Also, the present invention can be considered to relate also to the paper humidifier itself applied to the image forming system.

Although embodiments of the present invention have been described and illustrated in detail, it is clearly understood that the same is by way of illustration and example only and not limitation, the scope of the present invention should be interpreted by terms of the appended claims.

What is claimed is:

1. A paper humidifier comprising:

a humidifying roller which comes in contact with a sheet being conveyed, and humidifies the sheet;

a water supply roller which is in contact with the humidifying roller and transfers water to the humidifying roller;

a suction roller which is partially dipped into water stored in a water reservoir; and an intermediate roller which is provided between the water supply roller and the suction roller, and is in contact with the water supply roller and the suction roller respectively, wherein the intermediate roller is located above a liquid level of the water stored in the water reservoir, and wherein an outer peripheral surface of the suction roller, which rises out of the water stored in the water reservoir after being dipped in the water, rotates in a direction so that an outer peripheral surface of the suction roller that is farthest away from the water supply roller rotates toward the intermediate roller.

2. The paper humidifier of claim 1 wherein the intermediate roller is located above a liquid level of the water stored in the water reservoir, and wherein a nip portion is formed between the intermediate roller and the suction roller and located above the water reservoir.

3. The paper humidifier of claim 1 wherein a length of the intermediate roller in an axial direction is shorter than a length of the water supply roller in the axial direction.

4. The paper humidifier of claim 1 wherein a length of the intermediate roller in an axial direction is shorter than a length of the suction roller in the axial direction.

5. The paper humidifier of claim 1 further comprising:

a drainer roller which is in contact with the water supply roller to optimize the amount of water lingering on an outer peripheral surface of the water supply roller.

6. The paper humidifier of claim 1 wherein the water supply roller is located above the humidifying roller.

7. The paper humidifier of claim 1 further comprising:

a second humidifying roller which is in contact with the humidifying roller and located below the humidifying roller to humidify the sheet; and a second water supply roller which is in contact with the second humidifying roller to transfer water to the second humidifying roller, wherein the sheet to be humidified is conveyed in a horizontal direction through a nip portion between the humidifying roller and the second humidifying roller.

8. A paper humidifier comprising:

a humidifying roller which comes in contact with a sheet being conveyed, and humidifies the sheet;

a water supply roller which is in contact with the humidifying roller and transfers water to the humidifying roller;

a suction roller which is partially dipped into water stored in a water reservoir;

an intermediate roller which is provided between the water supply roller and the suction roller, and is in contact with the water supply roller and the suction roller respectively; and a drainer roller which is in contact with the water supply roller to optimize the amount of water lingering on an outer peripheral surface of the water supply roller;

wherein the intermediate roller is located above a liquid level of the water stored in the water reservoir, wherein a nip portion is formed between the intermediate roller and the suction roller and located above the water reservoir; and the drainer roller and the intermediate roller are on opposite sides of the water supply roller and rotate about axes that are above an axis about which the water supply roller rotates.

9. The paper humidifier of claim 8 wherein the water supply roller is located above the humidifying roller.

10. The paper humidifier of claim 8 further comprising:

a second humidifying roller which is in contact with the humidifying roller and located below the humidifying roller to humidify the sheet; and a second water supply roller which is in contact with the second humidifying roller to transfer water to the second humidifying roller, wherein the sheet to be humidified is conveyed in a horizontal direction through a nip portion between the humidifying roller and the second humidifying roller.

11. A paper humidifier comprising:

a humidifying roller which comes in contact with a sheet being conveyed, and humidifies the sheet;

a water supply roller which is in contact with the humidifying roller and transfers water to the humidifying roller;

a suction roller which is partially dipped into water stored in a water reservoir; and an intermediate roller which is provided between the water supply roller and the suction roller, and is in contact with the water supply roller and the suction roller respectively;

wherein the intermediate roller is located above a liquid level of the water stored in the water reservoir;

wherein a nip portion is formed between the intermediate roller and the suction roller and located above the water reservoir; and wherein a length of the intermediate roller in an axial direction is shorter than a length of the water supply roller in the axial direction.

12. The paper humidifier of claim 11 further comprising:

a drainer roller which is in contact with the water supply roller to optimize the amount of water lingering on an outer peripheral surface of the water supply roller.

13. A paper humidifier comprising:

a humidifying roller which comes in contact with a sheet being conveyed, and humidifies the sheet;

a water supply roller which is in contact with the humidifying roller and transfers water to the humidifying roller;

a suction roller which is partially dipped into water stored in a water reservoir; and an intermediate roller which is provided between the water supply roller and the suction roller, and is in contact with the water supply roller and the suction roller respectively;

wherein the intermediate roller is located above a liquid level of the water stored in the water reservoir;

wherein a nip portion is formed between the intermediate roller and the suction roller and located above the water reservoir; and wherein a length of the intermediate roller in an axial direction is shorter than a length of the suction roller in the axial direction.

14. An image forming system comprising:

an image forming apparatus which forms an image on a sheet; and a paper humidifier located in a downstream side of the image forming apparatus to humidify a sheet which is supplied from the image forming apparatus, wherein the paper humidifier comprises:

a humidifying roller which comes in contact with a sheet being conveyed, and humidifies the sheet;

a water supply roller which is in contact with the humidifying roller and transfers water to the humidifying roller;

a suction roller which is partially dipped into water stored in a water reservoir; and an intermediate roller which is provided between the water supply roller and the suction roller, and is in contact with the water supply roller and the suction roller respectively, wherein the intermediate roller is located above a liquid level of the water stored in the water reservoir, and wherein an outer peripheral surface of the suction roller, which rises out of the water stored in the water reservoir after being dipped in the water, rotates in a direction so that an outer peripheral surface of the suction roller that is farthest away from the water supply roller rotates toward the intermediate roller.

15. An image forming system comprising:

an image forming apparatus which forms an image on a sheet; and a paper humidifier located in a downstream side of the image forming apparatus to humidify a sheet which is supplied from the image forming apparatus, wherein the paper humidifier comprises:

a humidifying roller which comes in contact with a sheet being conveyed, and humidifies the sheet;

a water supply roller which is in contact with the humidifying roller and transfers water to the humidifying roller;

a suction roller which is partially dipped into water stored in a water reservoir;

an intermediate roller which is provided between the water supply roller and the suction roller, and is in contact with the water supply roller and the suction roller respectively; and a drainer roller which is in contact with the water supply roller to optimize the amount of water lingering on an outer peripheral surface of the water supply roller;

wherein the intermediate roller is located above a liquid level of the water stored in the water reservoir, and wherein a nip portion is formed between the intermediate roller and the suction roller and located above the water reservoir; and the drainer roller and the intermediate roller are on opposite sides of the water supply roller and rotate about axes that are above an axis about which the water supply roller rotates.

* * * * *